United States Patent [19]

Coupar

[11] 4,129,232

[45] Dec. 12, 1978

[54] FLUID SUBSTANCE TRANSPORTING AND STORAGE TANKS

[76] Inventor: Robert B. Coupar, 4447 Narvaez Crescent, Victoria, British Columbia, Canada, V8N 2S7

[21] Appl. No.: 824,115

[22] Filed: Aug. 12, 1977

[51] Int. Cl.[2] ..... B65D 47/30

[52] U.S. Cl. ..... 222/173; 222/510; 150/0.5

[58] Field of Search ..... 150/0.5, 1; 222/510, 222/518, 181, 185, 173

[56] References Cited

U.S. PATENT DOCUMENTS

| | | | |
|---|---|---|---|
| 1,558,597 | 10/1925 | Eckard | 222/510 |
| 2,287,824 | 6/1942 | Pihl | 150/0.5 UX |
| 2,390,699 | 12/1945 | Eustathopulo | 222/185 X |
| 2,492,699 | 12/1949 | Houwink | 150/1 UX |
| 2,690,778 | 10/1954 | Walsh | 150/0.5 |
| 2,696,235 | 12/1954 | Teffelon | 150/0.5 |
| 3,004,515 | 7/1962 | Eades | 150/0.5 UX |
| 3,097,677 | 7/1963 | Mitchell | 150/1 |

*Primary Examiner*—Donald F. Norton

*Attorney, Agent, or Firm*—Larson, Taylor and Hinds

[57] ABSTRACT

A tank in the form of a spherical wall having a discharge opening at the bottom thereof with a seat surrounding this opening. An inlet opening having a cover is provided at the top of the spherical wall. A plug in the chamber is positioned to engage the seat and thereby close the discharge opening. Operating means connected to the plug is operable selectively to move the plug onto and off the seat to close and open the discharge opening to retain fluid substance in the chamber and allow this substance to flow out of the chamber, respectively.

6 Claims, 7 Drawing Figures

FLUID SUBSTANCE TRANSPORTING AND STORAGE TANKS

This invention relates to a tank for transporting and storing fluid substances. The term "fluid" is intended to include liquids, such as oil, and materials in particulate form which will flow under gravity, such as grain, flour, and the like.

The present tank is primarily designed for transporting oil in ships, and is so described herein, but it may be used with other forms of transportation, such as trucks and railcars, and may be used for substance other than oil, such as fluid or fluidizable substances which need to be kept free of contamination or which themselves may cause contamination.

A large percentage of the oil used in the world has to be transported by ships from the wells to the various markets. Huge tankers carrying vast quantities of oil are in use, but these are unwieldy, somewhat dangerous to other shipping, and subject to damage and breakup resulting in vast quantities of oil being spilled into the oceans. Efforts have been made to provide shipping tanks that will hold oil in relatively small quantities so that if the transporting ship is holed or otherwise damaged, no leakage of oil is likely to occur, or if one or more tanks is or are damaged at the same time, the amount of oil spilled will be relatively small. Some efforts in this direction are illustrated by way of example in the following U.S. Pat. Nos. 2,048,312; 3,583,352; 3,712,257; 3,724,411.

An examination of these patents will reveal that the tanks envisioned are very large, are permanent installations in the ships, are comparatively complicated and costly, and are subject to rupture by the same forces that will rupture the hull of a vessel.

The present invention overcomes these problems by providing a tank of spherical form formed of a suitable material. This may be a pliable plastic material, such as neoprene, polyvinyl chloride, or the like, or a suitable metal, such as steel. It is preferable to provide a net bag around the outside of the tank to reinforce the latter, protect the outer surface of the tank, and enable the tank to be handled by cranes and the like. A supporting craddle is provided in the ship with receptacles shaped to receive the spherical tanks. Means is provided on the tank for stabilizing it in the craddle.

A transporting and storage tank according to this invention comprises a spherical wall enclosing a storage chamber for a fluid substance, a discharge opening in a portion of the wall constituting the bottom of the spherical wall, a seat in the chamber and surrounding the discharge opening, an inlet opening in a portion of the wall forming the top thereof, a cover for inlet opening, a plug in the chamber positioned to engage the seat and thereby close the discharge opening, and operating means connected to the plug and operable selectively to move said plug on to and off the seat respectively to close and open the discharge opening to retain the fluid substance in the chamber and to allow said substance to flow out of the chamber.

An example of this invention is illustrated in the accompanying drawings, in which FIG. 1 is a reduced plan view of a cradle with receptacles therein for receiving a tank, there being four receptacles showing, two of which have tanks therein, FIG. 2 is a reduced sectional view through a portion of the cradle showing a tank in one receptacle and another tank supported above another receptacle, FIG. 3 is an enlarged vertical section through one form of tank in accordance with this invention.

Figure 1:
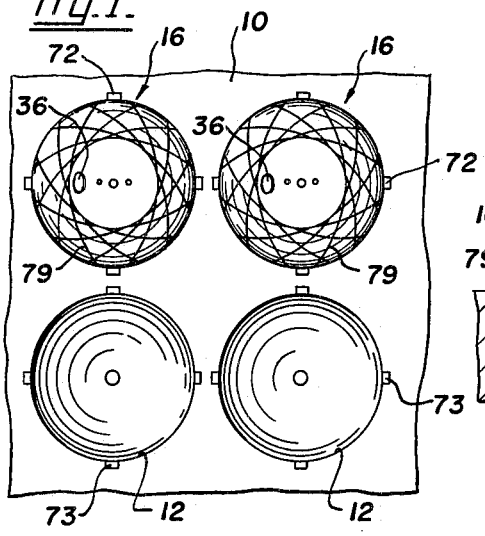
Figure 2:
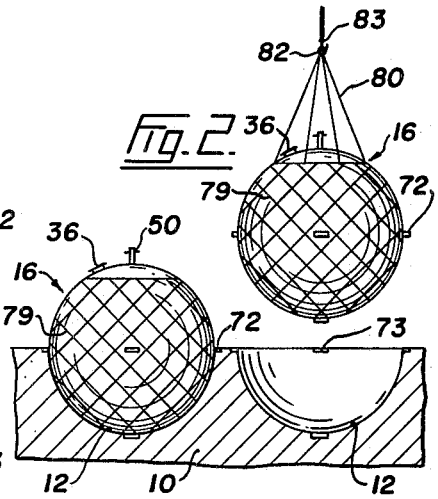
Figure 3:
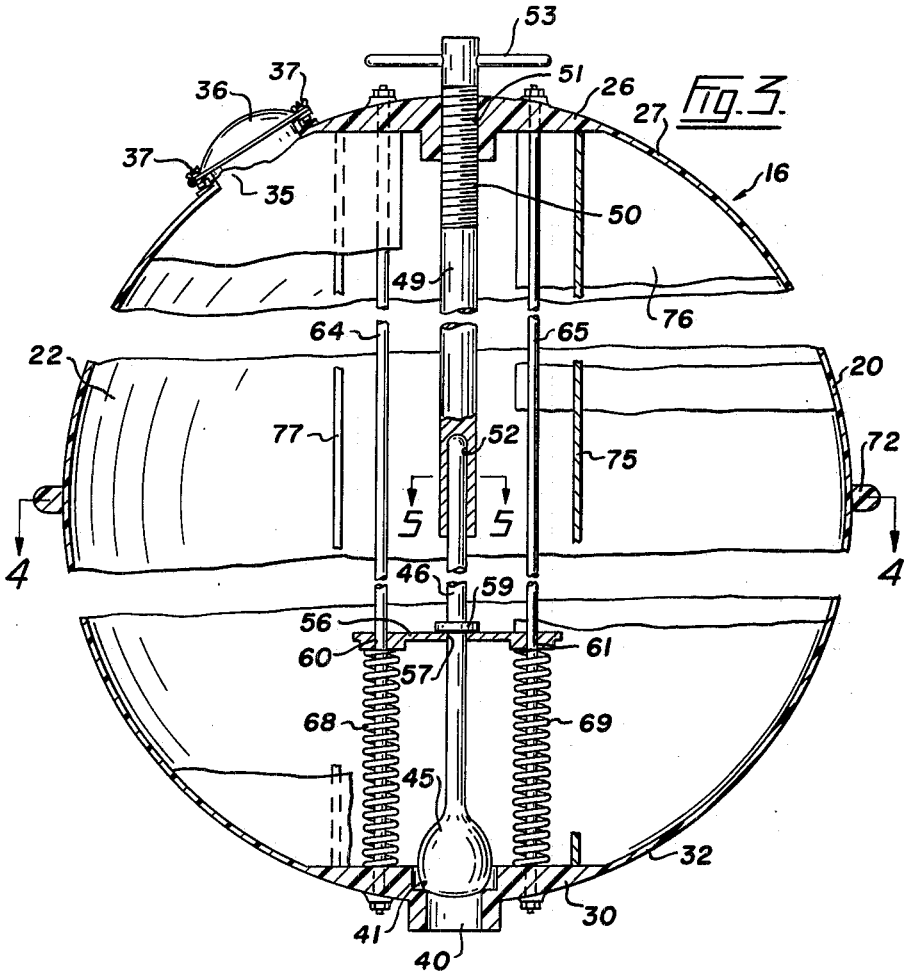
Figure 4:
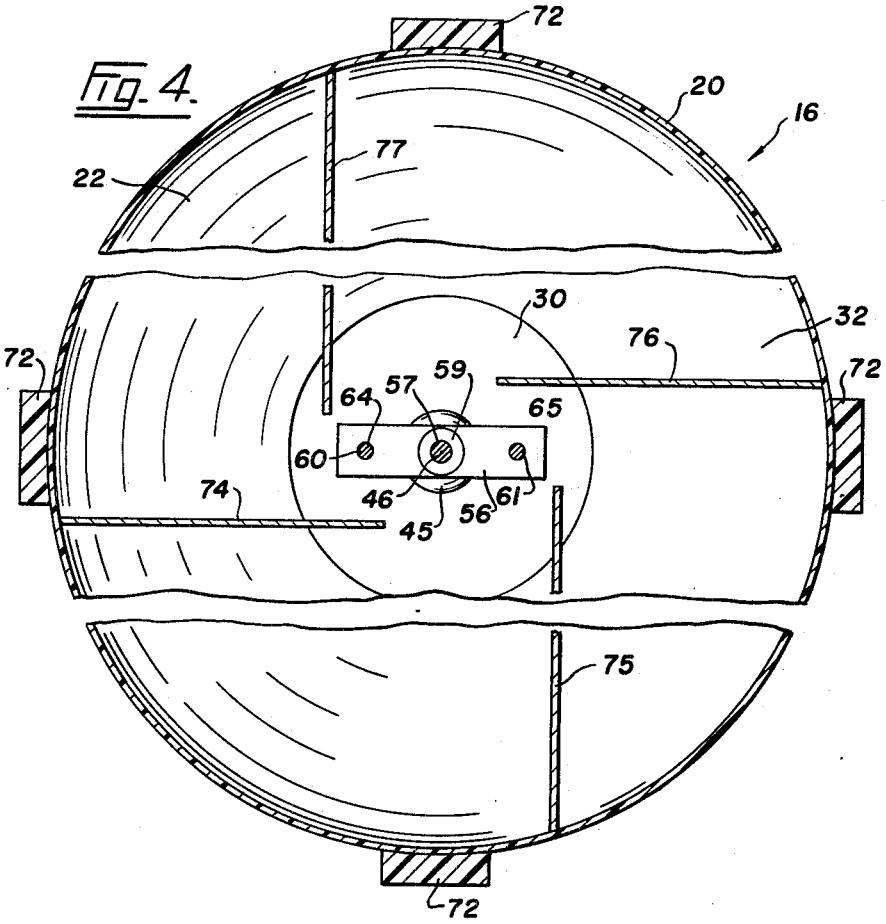
FIG. 4 is a horizontal section taken on the line 4—4 of FIG. 3.
Figure 5:
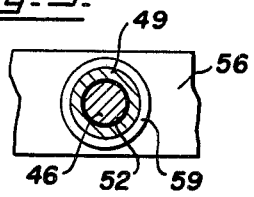
FIG. 5 is a fragmentary sectional veiw taken on the line 5—5 of FIG. 3.

Referring to FIGS. 1 and 2 of the drawings, 10 is a representative cradle that may be used with this invention, said cradle having a plurality of semi-spherical receptacles 12 therein for receiving spherical tanks or containers 16 in accordance with this invention. One of the tanks 16 is illustrated in detail in FIGS. 3 to 5 of the drawings.

Tank 16 is made up of a spherical wall 20 which is preferably formed of a suitable strong thin material, such as neoprene, polyvinyl chloride, steel or the like. A strong pliable plastic material is preferred since it is lighter than metal, and will yield if subjected to a blow without necessarily breaking or coming apart, as is the case with metal or rigid plastics. The size of tank 16 may be as desired, depending upon the space available for it and the type of material or liquid it is to contain. However, it is preferably small enough to be lifted, when loaded, by a crane.

Wall 20 encloses a chamber 22 for storing fluid substances, such as oil, wheat, flour, and the like. In the preferred example, tank 16 is formed with head means in the form of a rigid head 26 in the portion 27 of wall 20 which forms the top of the tank or container. Base means in the form of a rigid base 30 is provided in the tank in the portion 32 of wall 20 that forms the bottom of the tank. The head 26 and base 30 are formed of metal, rigid plastic material, or the like which can be securely mounted on or connected to the fabric of wall 20.

An inlet opening 35 is provided in the wall portion 27 at the top of the tank, and has a cover or hatch 36 removably secured in place in any suitable manner, such as by hold-down bolts 37. The opening 35 is preferably large enough to permit a man to enter the container.

A discharge opening 40 is provided at the bottom of tank 16. In this example, the opening is formed in base 30 centrally thereof, and a seat 41 is provided in the chamber and surrounding discharge opening 40.

A ball-like plug 45 normally rests on seat 41 to close the discharge opening 40. A stem 46 is secured to plug 45 and extends upwardly therefrom. Suitable operating means is connected to the plug, and in this example, a shaft 49 is formed with a threaded section 50 which is threaded in a tapped hole 51 in head 26, said shaft extending downwardly from the head and having an elongated recess 52 opening out from its lower end into which stem 46 movably fits. A bar or handle 53 extends through shaft 49 above head 26 of the container.

Guide means is provided for stem 46. In this example, the guide means includes a bar 56 having a central hole 57 therein, through which stem 46 freely extends. A collar 59 fixedly connected to stem 46 bears against bar 56. This bar has holes 60 and 61 extending therethrough near its opposite end and through which rods 64 and 65, respectively, slidably extend. The rods 64 and 65 are parallel to each other and to the stem-shaft combination 46, 49, extend from head 26 to base 30 and are fixedly secured to these elements. These rods act as braces for the spherical wall 20 of the tank and maintain the latter substantially in shape when the latter is empty or only partially full.

Coil springs 68 and 69 are mounted on rods 64 and 65 respectively between bar 56 and base 30, said springs normally being under compression and tending to urge the bar upwardly against collar 59.

Plug 45 has operating means connected thereto and operable selectively to move said plug onto and off the seat 41 to close and open discharge outlet 40. This operating means is made up of stem 46, shaft 49, bar 56 and springs 68, 69.

In order to stabilize the tank or container 16 in a receptacle 12 of cradle 10, a plurality of radial lugs 72 are secured to the spherical wall 20 and to project outwardly therefrom, these lugs being located in the plane of the horizontal diameter of the spherical tank. The lugs are positioned to fit into notches 73 formed in cradle 10 around each receptacle 12 thereof.

If desired, a plurality of baffles or wash plates may be provided in the container. In this example, vertical baffles 74, 75, 76, and 77 are provided in container 16, said baffles being secured to head 26 and base 30 and extending from near the centre of the container out to the wall thereof.

Although suitable loops or the like may be provided on head 26 to enable the tank 16 to be lifted, it is preferable to provide a net bag 79 formed of steel wire rope or other suitable material, and adapted to fit around the spherical tank, see FIGS. 1 and 2, and having cables 80 secured to the top thereof. These cables can be connected to a single ring 82 at their outer ends for receiving the hook 83 of a crane or other lifting device, although if desired, each cable may have its own loop at its outer end to be placed over the hook 83.

Tanks 16 are used for transporting or storing materials, and can be filled outside the transporting ship or storage shed or they may be loaded and unloaded in the ship and the shed. If they are loaded and unloaded outside, a cradle similar to cradle 10 would be necessary to support each tank during the loading and unloading operation.

In order to load a tank 16, its cover 36 is removed and the fluid substance is pumped, blown or otherwise directed in through inlet opening 35, plug 45 resting on seat 51 at this time to close the discharge outlet 40. When the tank is loaded, cover 36 is replaced and the tank is placed in a receptacle 12 of cradle 10 if it is not already therein. The rods 64 and 65 brace the tank internally and prevent the head 26 from moving downwardly towards base 30 under stress or when the tank is empty or only partly filled.

When it is desired to unload tank 16, shaft 49 is rotated by means of handle 53 so that threads 50 operating in the nut-like opening 51 shift the shaft upwardly. This allows springs 68, 69 to move bar 56 upwardly thereby lifting the plug off seat 41 to open the discharge opening 40. At this time, the contents of chamber 22 will flow out through opening 40. When all or a sufficient portion of the contents have been removed, shaft 49 is rotated in the opposite direction so that it is screwed downwardly to press stem 46 and collar 59 in the same direction to move plug 45 onto its seat against the pressure of springs 68, 69.

The tank 16 may be suspended in the manner shown in FIG. 2 during the unloading operation, at which time the tank is held above a suitable receiver or tank. On the other hand, tank 16 may be resting in a suitable cradle positioned over a receiver and constructed to allow the contents of the spherical tank to flow into the receiver.

Although the illustrated operating means for plug 45 is preferred, it is possible to eliminate the threads 50 of shaft 49, and to provide co-operating threads within the shaft recess 52 and on the upper end of stem 46 so that rotation of the shaft in one direction draws the stem upwardly, and rotation in the opposite direction moves the stem downwardly. In this case, springs 68, 69 are not necessary, but it would be necessary to provide a collar similar to collar 59 on the stem below bar 56. Suitable means would have to be provided to prevent rotation of stem 46, such as a key between the stem and bar 56. In both cases, the rods 64, 65 act as guides for the movement of bar 56, and consequently, for stem 46.

Figure 6:
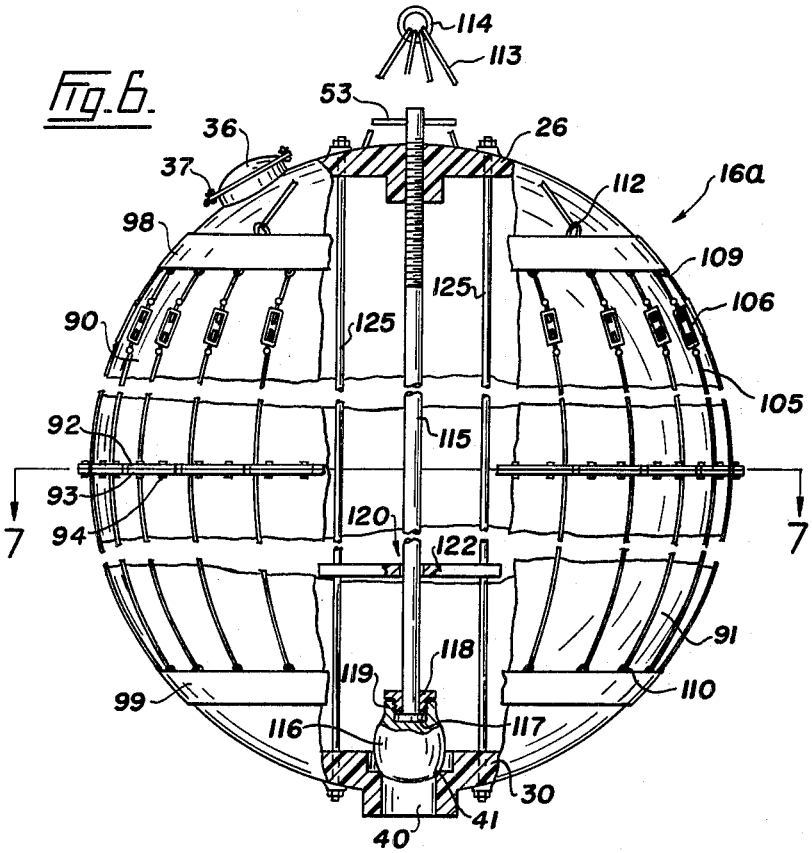
FIG. 6 is a vertical section through another form of tank according to this invention.
Figure 7:
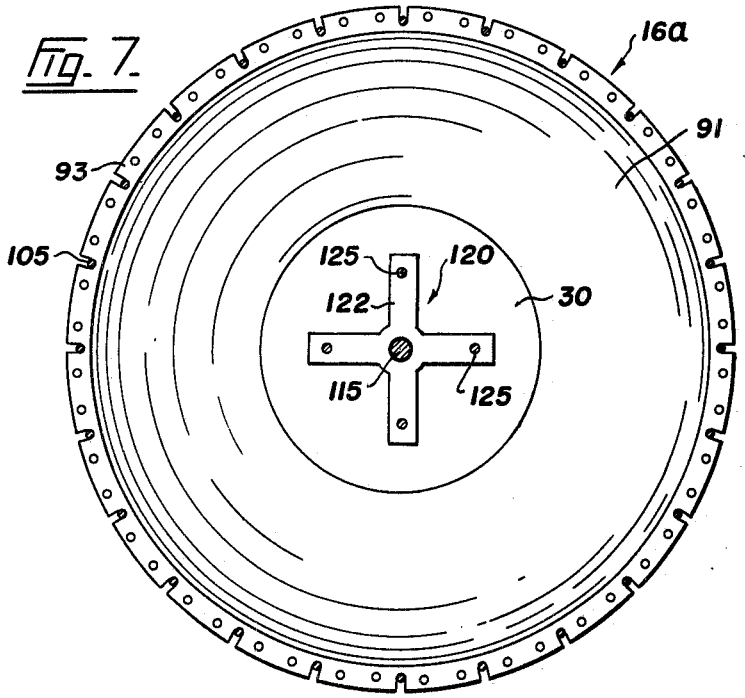
FIG. 7 is a horizontal section taken on the line 7—7 of FIG. 6.

FIGS. 6 and 7 illustrate an alternative form of tank **16*a* in accordance with this invention. Although the wall 20 of this tank may be formed of pliable material, such as neoprene or polyvinyl chloride, it is preferably formed of thin steel. In this example, the wall is formed in upper and lower semi-spherical sections 90 and 91 interconnected at adjacent edges by laterally spaced upper and lower lugs 92 and 93 on the upper and lower sections respectively, each upper lug being connected to a lower lug by bolts 94**.

A rigid, upper bracing ring 98 and a similar lower bracing ring 99 are respectively placed over the outer surface of the wall of upper section 90 spaced from the top of this section and the outer surface of the wall of the lower section 91 spaced upwardly a little from the bottom thereof. These collars preferably are free of the tank walls although they can be secured thereto if desired. A plurality of cables 105 extend between rings 98 and 99 and have turnbuckles 106 therein, by means of which the lengths of the respective cables can be adjusted. The cables 105 extend through spaces between lugs 92, 93 and are connected to rings 109 and 110 which are secured to rings 98 and 99. Additional rings 112 are secured to upper ring 98, and a lanyard 113 is connected to each of these rings. These lanyards extend upwardly to a common ring 114 for lifting purposes.

In tank **16*a* there is a shaft 115 threaded through head 26 and extending down into a plug 116 normally resting on seat 41. The lower end of shaft 115 is provided with a head 117 rotatably held in place by a plug 118 threaded into the neck 119 of the plug. Shaft 115 slidably extends through a brace 120. This brace has four radiating arms 122 which are secured at their outer ends to four vertical rods 125 which extend between and are secured to head 26 and base 30**.

Plug 116 is lifted off and replaced on seat 41 by rotating shaft 115 in the appropriate direction. Brace 120 supports this shaft and, in turn, is supported by rods 125. These rods brace tank **16*a* between the top and bottom thereof, while cables 105** brace the tank in the lateral direction.

If desired, tanks 16 and **16*a* can be fitted with flotation collars to make them buoyant in water. The flotation collar, not shown, can fit beneath the radial lugs 72 of tank 16, and can be attached to collar 98 of tank 16*a***.

I claim:

1. A tank for holding and transporting fluid substances, comprising: a spherical wall enclosing a storage chamber for a fluid substance; a discharge opening in a portion of the wall constituting the bottom of the spherical wall; a seat in the chamber and surrounding the discharge opening; an inlet opening in a portion of the wall forming the top thereof; a cover for the inlet opening; a plug in the chamber positioned to engage the seat and thereby close the discharge opening; and operating means connected to the plug and operable selectively to move said plug onto and off the seat respectively to close and open the discharge opening to retain said fluid substance in the chamber and to allow said substance to flow out of the chamber, said operating means comprising spring means connected to the plug and normally urging the latter away from the seat, nut means near the top portion of the wall and a shaft threaded through said nut means and extending out through said wall, said shaft having an inner end connected to the plug, whereby rotation of the shaft in one direction causes the shaft to move the plug onto the seat against the action of said spring means and rotation of the shaft in the opposite direction permits the spring means to move the plug off the seat.

2. A tank for holding and transporting fluid substances, comprising: a spherical wall enclosing a storage chamber for a fluid substance, the spherical wall being adapted to be seated in a supporting cradle and including radial lugs on the outer surface of the spherical wall to engage portions of the cradle to stabilize the tank in the cradle; a discharge opening in a portion of the wall constituting the bottom of the spherical wall; a seat in the chamber and surrounding the discharge opening; an inlet opening in a portion of the wall forming the top thereof; a cover for the inlet opening; a plug in the chamber positioned to engage the seat and thereby close the discharge opening, and operating means connected to the plug and operable selectively to move said plug onto and off the seat respectively to close and open the discharge opening to retain said fluid substance in the chamber and to allow said substance to flow out of the chamber.

3. A tank for holding and transporting fluid substances, comprising: a spherical wall formed of a pliable material and enclosing a storage chamber for a fluid substance; a rigid head in the chamber at a portion of the wall forming the top thereof; a rigid base in the chamber at a portion of the wall forming the bottom thereof; bracing means comprising rods extending between and connected to the head and the base to strengthen the tank; a discharge opening in the base and opening out from the chamber; a seat on the base and surrounding the discharge opening; a plug positioned to engage the seat and close said opening; operating means connected to the plug and extending through said head and out of the chamber, said operating means comprising a stem connected to the plug and extending inwardly of the chamber and parallel with said rods and guide means connected to the stem and slidable on the rods to maintain the plug in alignment with the seat, said operating means being operable to move said plug onto and off the seat respectively to close and open the discharge opening to retain said fluid substance in the chamber and to allow said substance to flow out of the chamber.

4. A tank as claimed in claim 3 in which said guide means comprises a bar connected to the stem and projecting laterally therefrom, said bar having ends slidably mounted on the rods.

5. A tank as claimed in claim 3 in which said operating means comprises springs between the ends of said bar and the base normally urging the plug off the seat, and a threaded shaft having an inner end engaging said stem, said shaft being threaded through said head and extending out of the chamber, whereby rotation of the shaft in one direction causes the shaft to move the plug on the seat against the action of the springs, and rotation of the shaft in the opposite direction permits the springs to move the plug off the seat.

6. A tank as claimed in claim 5 in which said spherical wall is adapted to be seated in a supporting cradle, and including radial lugs on the outer surface of the spherical wall to engage portions of the cradle to stabilize the tank in the cradle.

* * * * *